United States Patent [19]

Bayer et al.

[11] Patent Number: 4,724,903

[45] Date of Patent: Feb. 16, 1988

[54] HEAT EXCHANGER IN PARTICULAR FOR MOTOR VEHICLES

[75] Inventors: Juergen Bayer, Esslingen; Reinhold Heck, Gerlingen; Karl-Ernst Hummel, Bietigheim; Reinhold Kuchelmeister, Waldenbuch, all of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 828,641

[22] Filed: Feb. 12, 1986

[30] Foreign Application Priority Data

Feb. 15, 1985 [DE] Fed. Rep. of Germany ..... 3505196

[51] Int. Cl.[4] ..... F28F 9/02; F28F 9/16

[52] U.S. Cl. ..... 165/173; 165/175; 165/151; 29/157.4

[58] Field of Search ..... 165/173, 175, 178, 151; 285/158, 189, 192, 20, 222, 382.4; 29/157.4

[56] References Cited

U.S. PATENT DOCUMENTS

| | | | |
|---|---|---|---|
| 1,744,932 | 1/1930 | Swank | 165/173 X |
| 2,349,792 | 5/1944 | Rosenblad | 165/173 X |
| 2,368,391 | 1/1945 | Young | 165/134.1 |
| 2,886,881 | 5/1959 | Huet | 285/381 X |
| 3,739,840 | 6/1973 | Jones | 29/157.4 |
| 4,159,741 | 7/1979 | Nonnenmann et al. | 29/157.4 |
| 4,226,280 | 10/1980 | de Cenival | 165/173 |
| 4,236,577 | 12/1980 | Neudeck | 285/20 X |
| 4,316,503 | 2/1982 | Kurachi et al. | 29/157.4 |
| 4,456,059 | 6/1984 | Cadars | 165/173 |
| 4,576,223 | 3/1986 | Humpolik et al. | 165/175 |

FOREIGN PATENT DOCUMENTS

| | | | |
|---|---|---|---|
| 2429370 | 2/1975 | Fed. Rep. of Germany | 29/157.4 |
| 2429370 | 2/1975 | Fed. Rep. of Germany | 165/175 |
| 2236578 | 2/1975 | France | 165/173 |
| 622421 | 5/1949 | United Kingdom | 165/175 |
| 1445598 | 8/1976 | United Kingdom | 165/175 |

*Primary Examiner*—William R. Cline
*Assistant Examiner*—John K. Ford
*Attorney, Agent, or Firm*—Schwartz, Jeffery, Schwaab, Mack, Blumenthal & Evans

[57] ABSTRACT

Heat exchanger having a tube plate made of plastic, in which metallic tubes are fixed. The tube plate has elevations having openings for accommodating the tube ends, with the openings being subdivided into three sections in axial extension. The center section has the smallest cross-section and the end sections are in each case widened. The elevations extend on both sides of the tube plate, the total height of the elevations located in the area of an opening, inclusive of the tube plate thickness, being about 1.8 to 2.5 times the single tube plate thickness.

19 Claims, 4 Drawing Figures

HEAT EXCHANGER IN PARTICULAR FOR MOTOR VEHICLES

FIELD OF THE INVENTION

The invention relates to a heat exchanger, in particular for motor vehicles.

RELATED ART

A heat exchanger having a radiator tank made of plastic and also a tube plate made of plastic is disclosed in German Offenlegungsschrift No. 3,247,502. On one side, the tube plate has a plurality of elevations, which have openings for accommodating heat exchanger tubes. The openings can be subdivided into several sections in an axial direction, the center section having a constant cross-section. In the arrangement disclosed, reference is also made to the possibility of providing end sections widened in cross-section on both sides of the center section. The tubes are fixed in the openings by widening them out, that is, by pressing in the radial direction.

SUMMARY OF THE INVENTION

It is the object of the present invention to further develop a heat exchanger such that greater pressure forces fix and seal the heat exchanger tubes in the tube plate, thereby achieving a more favorable distribution of pressure forces. Further, distortion of the tube plate with reference to the tube plate plane is prevented. This object is achieved in a heat exchanger comprising an elongated housing with an opening formed therein. means are provided for distributing a substantially constant change in pressure across end sections of the opening and for distributing a substantially constant pressure across a mid-section of the opening. The pressure distribution means may comprise elevations disposed on upper and lower surfaces of the the housing. The elevations may have apertures formed therethrough, such that the apertures are extensions of the opening. The apertures may be frusto-conically shaped, in order to achieve a desired pressure distribution.

A further object of the invention is to achieve an optimum mass distribution. This is accomplished by arranging the elevations on both sides of the tube plate so that the mass center of the tube plate is located at approximately half the height of the tube plate and therefore in its center. In this manner, the greatest pressure force is absorbed in the center section of the openings, which have a large axially extending surface, rather than at the end of the openings (as in other devices). This results in a very favorable stress profile with respect to the axial extent of the openings, so that a more favorable distribution of the compressive stress in the tube plate enables greater pressure forces to act.

These and other objects of the invention are achieved by a heat exchanger tube comprising a tube plate having a first plurality of elevations disposed on an upper surface, the tube plate and a second plurality of elevations disposed on a lower surface of the tube plate. One set of elevations has a height less than or equal to twice the height of the other set of elevations. A plurality of openings having heat exchanger tubes disposed therethrough extend through the tube plate and the elevations. The openings have outwardly tapered end sections. The total height of the tube plate and the elevations is between approximately 1.8 and 2.5 times the height of the tube plate alone. The openings have a central axial section disposed between the end sections which is between one and two times the height of the tube plate.

BRIEF DESCRIPTION OF THE DRAWINGS

An exemplary embodiment of the invention is described in greater detail below with reference to the drawing, in which.

DETAILED DESCRIPTION OF PREFERRED EMBODIMENTS

The axial length of the center section of the openings is preferably 1.6 times to 1.8 times the normal tube plate thickness. In this manner, an adequate, but not necessarily large, axial extent is provided for the center section upon which the maximum compressive stress is exerted. Another object of the invention is to achieve an advantageous mass distribution on both sides of the tube plate center. To this end, the center openings of the tube plate extend approximately uniformly on both sides of the tube plate. Also the height of the elevations arranged on the side facing away from a heat exchanger block is 1 to 1.5 times the height of the elevations located on the side facing toward the heat exchanger block.

For reasons related to manufacture, it is expedient that the center section has a cone which widens in the direction of the heat exchanger block with an opening angle of 1° to 3°. In this way, removal from the mold is facilitated when the tube plate is ejected from the injection molding die. Further, insertion of the tube into the opening of the tube plate is aided. A conical design of the end section adjacent to the heat exchanger block serves as a measure for self-centering of the tube during insertion into the opening of the tube plate, with the opening angle of the cone being about 15°.

The end section remote from the heat exchanger block has a cone with an opening angle of about 10°. So that the compressive stress, exactly at the end of the opening remote from the heat exchanger block reaches the value of zero it is preferable that the diameter at the outer end of the cone is equal to the outside diameter of the heat exchanger. So that this area extends approximately uniformly on both sides of the tube plate center, and a particularly advantageous mass distribution is achieved on both sides of the tube plate center, it is expedient that the height of the elevations which are arranged on the side facing away from a heat exchanger block is 1 to 1.5 times the height of the elevations located on the side facing toward the heat exchanger block.

According to an advantageous further development of the inventive subject, the end section remote from the heat exchanger block has a cone with an opening angle of about 10°. So that the compressive stress, exactly at the end of the opening reaches the value of $\sigma=0$, it is of advantage that the diameter at the outer end of the cone is equal to the outside diameter of the heat exchanger tube fixed in the opening. To achieve a favorable ratio of the center section to the end sections, it is expedient that the axial length of each end section is about 1/7 of the total axial length of the opening. It is also favorable that the heat exchanger tube, on the side facing away from the heat exchanger block, projects out of the tube plate, and in fact by a length which corresponds at least to the axial length of the end section.

Figure 1:
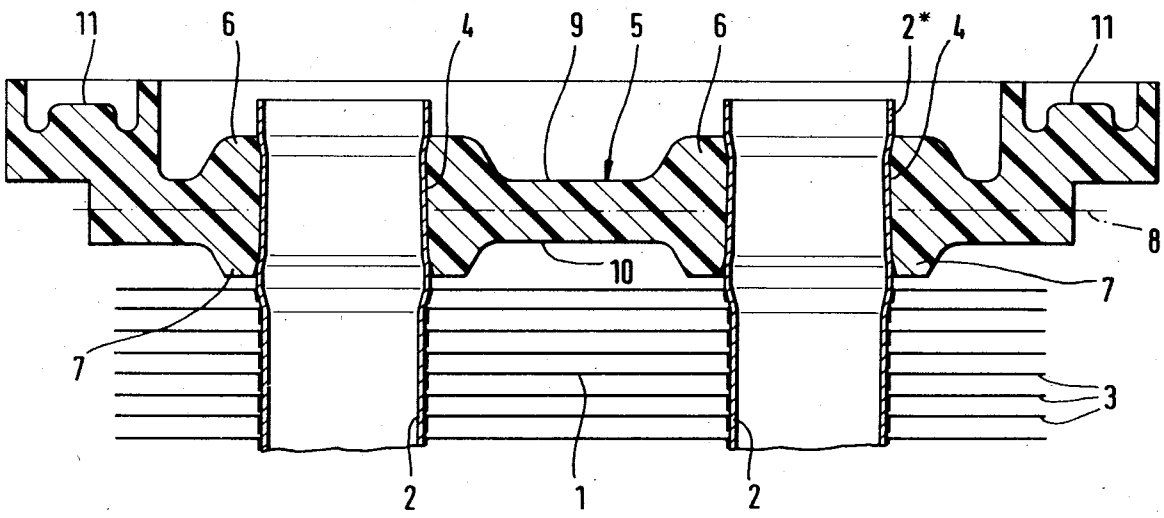
FIG. 1 shows a section through a tube plate and a part of the ribbed tube block of a heat exchanger.

FIG. 1 shows a partial section of a heat exchanger block 1 which consists of heat exchanger tubes 2 and ribs 3 arranged transversely to the tubes 2. The ends 2* of the heat exchanger tubes 2 are located in openings 4 of a tube plate 5 which is made of a plastic material, preferably of glass fiberreinforced polypropylene or polyamide. The heat exchanger tubes 2 are fixed in the tube plate 5 by opening them out. Details on the embodiment of the openings 4 are stated further below with reference to FIG. 2. Two elevations 6 and 7 are disposed on each side of the openings 4. Accordingly, the tube plate 5 is substantially thicker immediately adjacent to the openings 4.

The geometric center, that is, the center line between the upper tube plate plane 9 and the lower tube plate plane 10, is designated by the reference numeral 8. A connecting surface 11 for locating a radiator tank (not shown in the drawing) is provided in the edge area of the tube plate 5.

Figure 2:
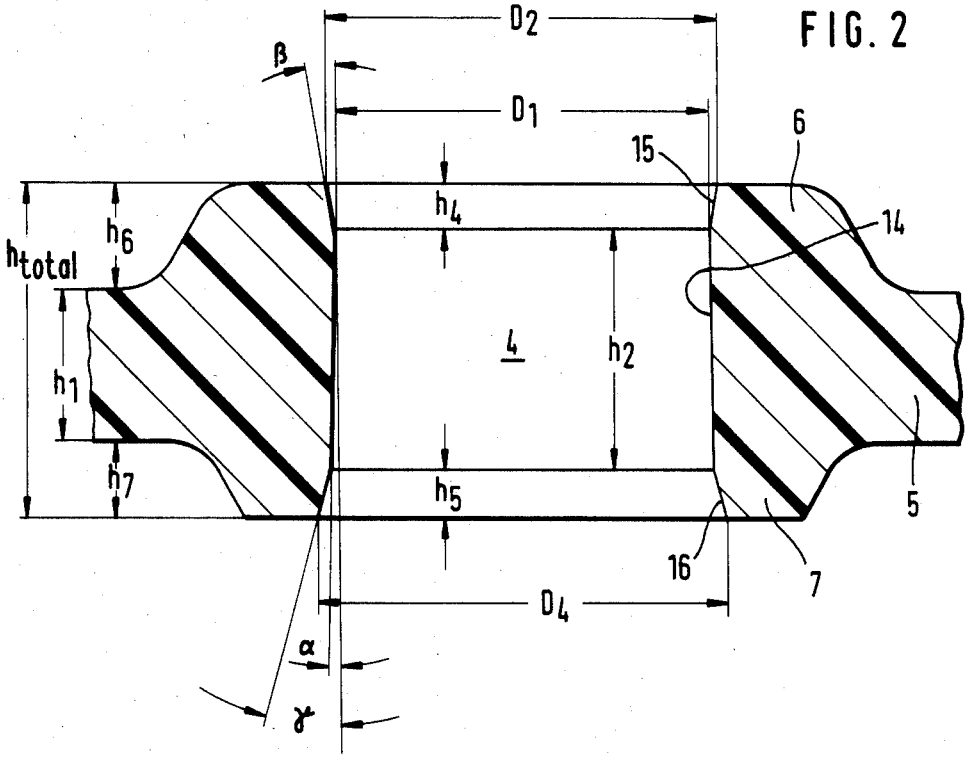
FIG. 2 shows an enlarged representation of the design of the elevations and the opening in the tube plate.

FIG. 2 shows a section through a part of the tube plate 5 having, as seen in the drawing, an upwardly directed elevation 6 and a downwardly directed elevation 7. In the area next to the elevations 6 and 7, the tube plate 5 has a normal thickness of $h_1$, whereas in the area of the elevations 6 and 7, the tube plate 5 has a total thickness $h_{total}$ which is made up of the normal thickness $h_1$, the height $h_6$ of the elevation 6, and the height $h_7$ of the elevation 7. In the illustrative embodiment according to FIG. 2, the total thickness $h_{total}$ is about 2.2 times the normal thickness $h_1$ of the tube plate 5.

An opening 4 is disposed in the tube plate between the elevations 6 and 7. The opening comprises a center section 14 and also end sections 15 and 16. The center section 14 of opening 4 extends over an axial length $h_2$ and has an at least approximately constant opening cross-section $D_1$, thereby defining a substantially cylindrical surface or, as shown in FIG. 2, slightly conical surface. In the latter case, the opening angle $\alpha$ is about 1°, so that the opening cross-section $D_1$ in the center section 14 does not change significantly. The slightly conical design of the center section is mainly provided so that the tube plate 5 can be more easily released from the injection molding die.

The end section 15 arranged in the elevation 6 has a cone tapering toward the center section 14, with the angle $\beta$ of this cone being about 10°. The end section 15 has a minimum diameter $D_1$ equal to that of the center section 14. The end section 15 has an increased diameter $D_2$ at the upper edge of the elevation 6. The end section 15 has an axial length $h_4$ which is about 1/7 of the total thickness $h_{total}$. At the other end of the openign 4 is located the end section 16 which is also made conical, but with the opening angle Y of the cone being directed in the opposite direction to that of the end section 15 and having a value of about 15°. The opening 4 has its greatest diameter $D_4$ at the outer edge of the elevation 7. The axial length $h_5$ of the end section 16 is approximately 1/7 of the total thickness $h_{total}$, so that the axial lengths of both end sections 15 and 16 are substantially the same.

Figure 3:
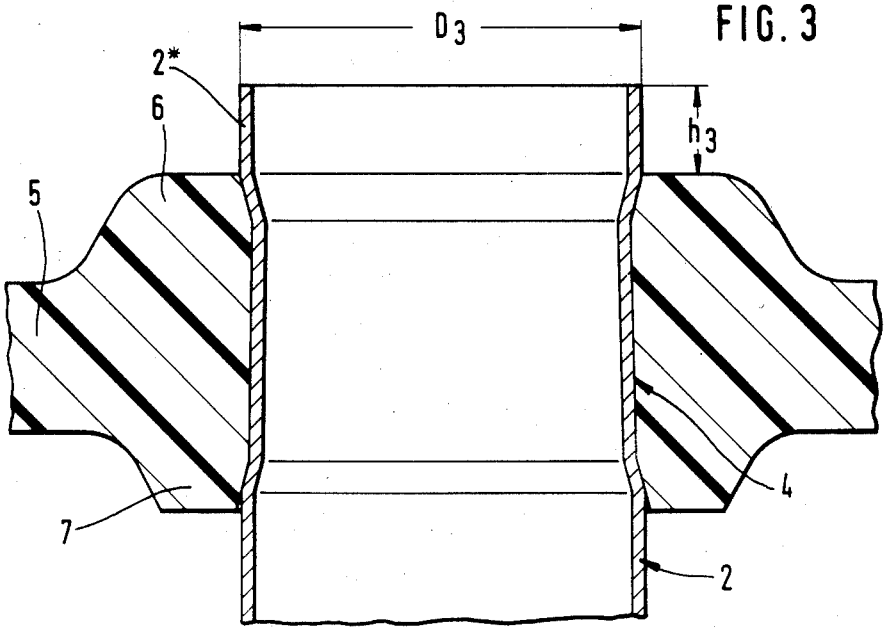
FIG. 3 shows an arrangement according to FIG. 2 having a heat exchanger tube fixed in the opening.

FIG. 3 shows a section through a tube plate 5 according to FIG. 2 having a heat exchanger tube 2 fixed in the opening 4. As shown by the cross-hatching of the drawings, heat exchanger tube 2 may be made of metal. The heat exchanger tube 2 is inserted through section 16 of the opening 4 of the tube plate 5 and pushed through until the end of the heat exchanger tube projects on the side of the elevation 6. The heat exchanger tube 2 is fixed in the opening 4 of the tube plate 5 by radial deformation, i.e., a pressure force which is uniform over the entire axial length of the center section 14 is produced in the center section 14 of the opening 4 as a result of the constant or approximately constant cross-section. The heat exchanger tube 2 is radially deformed to such an extent that the heat exchanger tube end 2* projecting out of the elevation 6 has a diameter $D_3$ which corresponds exactly with the diameter $D_2$ at the outer end of the end section 15.

Figure 4:
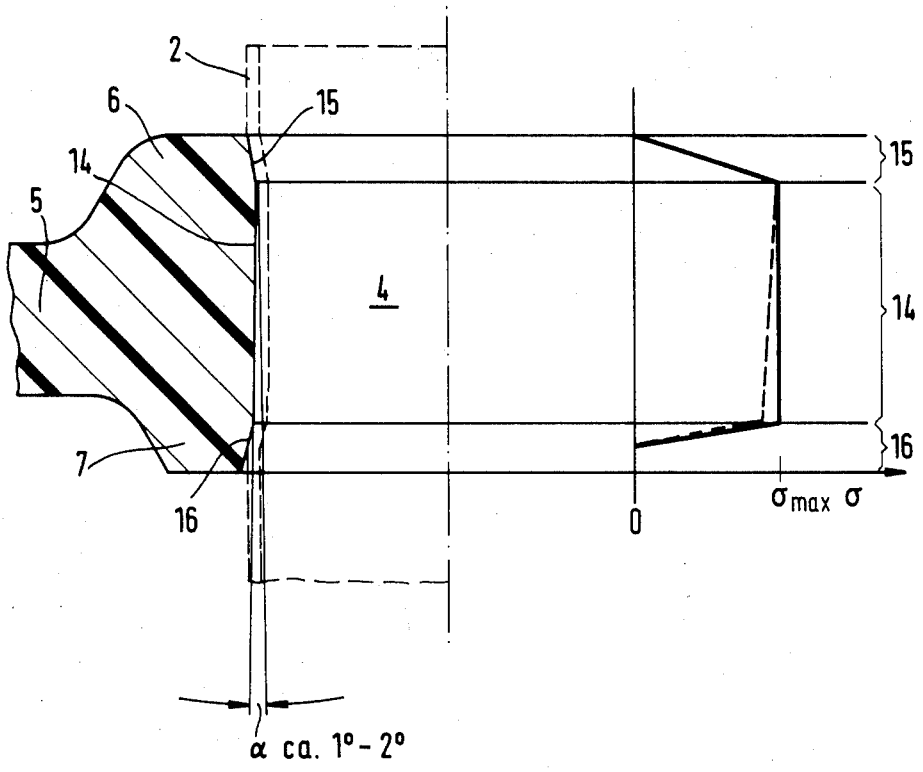
FIG. 4 shows a stress diagram on the distribution of the compressive stress.

FIG. 4 shows a diagram of the compressive stress profile. The size of the compressive stress is plotted over the axial length of the bore 4 which is formed by the partial lengths $h_2$, $h_4$ and $h_5$. For better comprehension the contour of the opening 4 in the tube plate 5 and the tube 2 fixed in the opening 4 are shown in the left-hand part of FIG. 4. The diagram of the stress profile of the compressive stress $\sigma$ in the respective sections 14, 15 and 16 of the opening is shown in the right-hand part of FIG. 4. As can be seen from this diagram, the cone of the end section 15 is selected in such a way that a uniform increase is achieved, starting at the value $\sigma=0$ at the upper edge of elevation 6 until the value $\sigma_{max}$ is reached at the transition from the end section 15 to the center section 14, that is, at the point of minimum opening cross-section of the opening 4. Provided the center section 14 has a constant cross-section over its axial length, the stress profile corresponds to the solid line in the diagram in the area of the center section 14. Because of the widening of the cross-section in the end section 16, compressive stress $\sigma$ very abruptly decreases down to the value $\sigma=0$. Because of the larger opening angle Y of the cone in the end section 16, zero compressive stress is achieved within this end section before reaching the outer edge.

Provided the center section 14, as shown in FIG. 2, is slightly conical with an opening angle $\alpha$, a stress profile results which corresponds to the broken line in the diagram. Because of the slight cross-section change towards the end section 15, a reduction in the compressive stress takes place which, however, only has an insignificant effect and does not impair the strength and the tightness of the connection between the tube 2 and the tube plate 5.

What is claimed is:

1. A heat exchanger, comprising:

a tube plate of plastic material;

a first plurality of integral elevations disposed on one of an upper and a lower surface of said tube plate;

a second plurality of integral elevations disposed on the other of said upper and lower surfaces of said tube plate, the height of said second elevation from said other surface being less than or equal to twice the height of said first elevation from said one surface;

a plurality of openings extending through said first and second elevations and said tube plate, said openings having outwardly tapered end sections; and a plurality of metal heat exchanger tubes expanded in said openings to secure the tubes in said openings, wherein the total height of said first and second elevations and said tube plate is between approximately 1.8 and 2.5 times the normal thickness of said tube plate between said upper and lower surfaces; and wherein a central axial extent of said opening between said outwardly tapered end sections is between approximately 1 and 2 times the normal thickness of said tube plate.

2. Heat exchanger as claimed in claim 1, wherein said central axial extent is between approximately 1.6 and 1.8 times the normal thickness of said tube plate.

3. Heat exchanger as claimed in claim 1, wherein said first elevation is disposed facing a heat exchanger block, said second elevation is disposed facing away from the heat exchanger block, and said second elevation is between approximately 1 and 1.5 times the height of said first elevation.

4. Heat exchanger as claimed in claim 1, wherein said central axial extent is frusto-conically shaped so as to widen at an angle between 1° and 3°, said angle widening toward a heat exchanger block.

5. Heat exchanger as claimed in claim 1, wherein one of said outwardly tapered end sections is adjacent to a heat exchanger block and tapers at an angle of approximately 15°.

6. Heat exchanger as claimed in claim 1, wherein one of said outwardly tapered end sections is remote from a heat exchanger block and tapers at an angle of approximately 10°.

7. Heat exchanger as claimed in claim 6, wherein a maximum diameter of said one of said outwardly tapered end sections is equal to a diameter of said heat exchanger tubes.

8. Heat exchanger as claimed in claim 1, wherein a terminal axial extent of each of said outwardly tapered end sections is approximately 1/7 of a total axial extent including said central axial extent and said terminal axial extents.

9. Heat exchanger as claimed in claim 8, wherein said heat exchanger tubes have first ends facing away from a heat exchanger block;

wherein said first ends project out from said tube plate by a length greater than or equal to said terminal axial extent.

10. A heat exchanger comprising:

a tube plate of plastic material;

at least one opening extending through said tube plate;

first means disposed on an upper surface of said tube plate and comprising a section of said at least one opening tapering outwardly toward an upper open end thereof for distributing a substantially uniform increase in compressive stress across a first axially extending end section of said at least one opening;

second means for distributing a substantially constant compressive stress across a second axially extending mid-section of said at least one opening;

third means disposed on a lower surface of said tube plate and comprising a section of said at least one opening tapering outwardly toward a lower open end thereof for distributing a substantially uniform decrease in compressive stress across a third axially extending end section of said at least one opening and at least one metal heat exchange tube expanded in said at least one opening to secure the tube therein.

11. The heat exchanger of claim 10, wherein said substantially uniform increase changes at a lesser rate than said substantially uniform decrease.

12. The heat exchanger of claim 10, wherein:

said first means comprises a first elevation disposed on a portion of an upper surface of said tube plate and having a first aperture therethrough, wherein said first aperture is an extension of said at least one opening;

said second means comprises an inner surface of said tube plate defining a perimeter of said at least one opening; and said third means comprises a second elevation disposed on a portion of a lower surface of said tube plate and having a second aperture therethrough, wherein said second aperture is an extension of said at least one opening.

13. The heat exchanger of claim 12, wherein a total height is defined by the sum of a height of said first elevation with respect to said upper surface, a normal thickness of said tube plate, and a height of said second elevation with respect to said lower surface; and said total height is between 1.8 and 2.5 times the normal thickness of the tube plate.

14. The heat exchanger of claim 12, wherein one of said first and second elevations is of a height less than or equal to twice the height of the other of said first and second elevations.

15. The heat exchanger of claim 12, wherein said first aperture comprises a first frusto-conical inwardly tapered extension of said at least one opening; and wherein said second aperture comprises a second frusto-conical outwardly tapered extension of said at least one opening.

16. The heat exchanger of claim 15, wherein said first frusto-conical extension is tapered at an angle of approximately 10°;

said second frusto-conical extension is tapered at an angle of approximately 15°; and said inner surface of said tube plate is tapered outwardly toward second elevation at an angle between approximately 1° and 3°.

17. The heat exchanger of claim 15, further comprising:

a heat exchanger tube disposed through said first aperture, said at least one opening, and said second aperture;

wherein an outer diameter of said first aperture is equal to a maximum diameter of said heat exchanger tube.

18. The heat exchanger of claim 15, wherein:

said first aperture further comprises a first substantially cylindrical extension of said at least one opening disposed between said at least one opening and said first frusto-conical extension; and said second aperture further comprises a second substantially cylindrical extension of said at least one opening disposed between said at least one opening and said second second frusto-conical extension.

19. The heat exchanger of claim 18, wherein said tube plate comprises reduced thickness portions adjacent to each of said first and second elevations, and wherein a total axial length of said at least one opening and said first and second substantially cylindrical extension is between 1 and 2 times the height of said reduced thickness portions.

* * * * *